US009184033B2

(12) United States Patent
Nützel et al.

(10) Patent No.: US 9,184,033 B2
(45) Date of Patent: Nov. 10, 2015

(54) ELECTRON MULTIPLYING STRUCTURE FOR USE IN A VACUUM TUBE USING ELECTRON MULTIPLYING AS WELL AS A VACUUM TUBE USING ELECTRON MULTIPLYING PROVIDED WITH SUCH AN ELECTRON MULTIPLYING STRUCTURE

(75) Inventors: Gert Nützel, Brive la Gaillarde (FR); Pascal Lavoute, Brive la Gaillarde (FR); Richard Jackman, Brive la Gaillarde (FR)

(73) Assignee: PHOTONIS FRANCE SAS, Brive la Gaillarde (FR)

( * ) Notice: Subject to any disclaimer, the term of this patent is extended or adjusted under 35 U.S.C. 154(b) by 345 days.

(21) Appl. No.: 13/700,185

(22) PCT Filed: May 27, 2011

(86) PCT No.: PCT/NL2011/050372

§ 371 (c)(1),
(2), (4) Date: Feb. 15, 2013

(87) PCT Pub. No.: WO2011/149351

PCT Pub. Date: Dec. 1, 2011

(65) Prior Publication Data

US 2013/0134864 A1 May 30, 2013

Related U.S. Application Data

(60) Provisional application No. 61/349,676, filed on May 28, 2010.

(30) Foreign Application Priority Data

May 28, 2010 (NL) ..... 1037989

(51) Int. Cl.
*H01J 1/62* (2006.01)
*H01J 43/04* (2006.01)

(Continued)

(52) U.S. Cl.
CPC . *H01J 43/04* (2013.01); *H01J 1/32* (2013.01); *H01J 31/48* (2013.01); *H01J 31/506* (2013.01); *H01J 43/16* (2013.01)

(58) Field of Classification Search
CPC ..... H01J 1/32; H01J 31/506; H01J 29/023; H01J 9/125; H01L 51/5203
See application file for complete search history.

(56) References Cited

U.S. PATENT DOCUMENTS 4,628,273 A 12/1986 Vlasak
5,986,387 A * 11/1999 Niigaki et al. ..... 313/103 R (Continued)

FOREIGN PATENT DOCUMENTS

EP 0841684 A2 5/1998
EP 1369900 A1 12/2003

(Continued)

OTHER PUBLICATIONS

Search Report for Dutch Patent Application No. 1037989; Dec. 20, 2010.

(Continued)

*Primary Examiner* — Andrew Coughlin
(74) *Attorney, Agent, or Firm* — Barnes & Thornburg LLP

(57) ABSTRACT

An electron multiplying structure for use in a vacuum tube using electron multiplying, the electron multiplying structure having an input face intended to be oriented in a facing relationship with an entrance window of the vacuum tube, an output face intended to be oriented in a facing relationship with a detection surface of the vacuum tube, wherein the electron multiplying structure at least is composed of a semiconductor material layer adjacent the detection windows. Also disclosed is a vacuum tube using electron multiplying with an electron multiplying structure.

15 Claims, 8 Drawing Sheets

(51) Int. Cl.

| | |
|---|---|
| ***H01J 1/32*** | (2006.01) |
| ***H01J 31/48*** | (2006.01) |
| ***H01J 31/50*** | (2006.01) |
| ***H01J 43/16*** | (2006.01) |

(56) References Cited

U.S. PATENT DOCUMENTS

| | | | | |
|---|---|---|---|---|
| 6,045,677 | A | 4/2000 | Beetz, Jr. et al. | |
| 2003/0038587 | A1* | 2/2003 | Onishi | 313/496 |
| 2005/0104527 | A1 | 5/2005 | Niigaki et al. | |
| 2007/0164663 | A1 | 7/2007 | Yokoyama | |

FOREIGN PATENT DOCUMENTS

| | | | |
|---|---|---|---|
| JP | 2002-343278 | A | 11/2002 |
| JP | 2003-263952 | A | 9/2003 |
| JP | 2006-243795 | A | 9/2006 |
| JP | 2006-521680 | A | 9/2006 |
| JP | 2009-99468 | A | 5/2009 |

OTHER PUBLICATIONS

Search Report for International Patent Application No. PCT/NL2011/050372; Oct. 10, 2011.

Japanese Office Action for Japanese Patent Application No. 2013-512558, along with English Translation, dated Mar. 10, 2015.

* cited by examiner

ELECTRON MULTIPLYING STRUCTURE FOR USE IN A VACUUM TUBE USING ELECTRON MULTIPLYING AS WELL AS A VACUUM TUBE USING ELECTRON MULTIPLYING PROVIDED WITH SUCH AN ELECTRON MULTIPLYING STRUCTURE

PRIORITY CLAIM

This patent application is a U.S. National Phase of International Patent Application No. PCT/NL2011/050372, filed 27 May 2011, which claims priority to U.S. Provisional Patent Application No. 61/349,676, filed 28 May 2010, and Dutch Patent Application No. 1037989, filed 28 May 2010, the disclosures of which are incorporated herein by reference in their entirety.

FIELD

Disclosed embodiments relate to an electron multiplying structure for use in a vacuum tube using electron multiplying.

Disclosed embodiments also relate to a vacuum tube using electron multiplying provided with such an electron multiplying structure.

For purposes of the disclosed embodiments, vacuum tube structures using electron multiplying comprise, among others, image intensifier tube devices, open faced electron multipliers, channeltrons, microchannel plates and also sealed devices like image intensifiers and photomultipliers that incorporate elements or subassemblies like discrete dynodes and microchannel plates that use the phenomenon of secondary emission as a gain mechanism. Such vacuum tubes are known in the art. They comprise a cathode which under the influence of incident radiation, such as light or X-rays, emits so-called photo electrons which under the influence of an electric field move towards an anode. The electrons striking the anode constitute an information signal, which signal is further processed by suitable processing means.

BACKGROUND

In modern image intensifier tubes an electron multiplying structure, mostly a microchannel plate or MCP for short, is placed between the cathode and the anode to increase the image intensification. In the case that the electron multiplying structure is constructed as a channel plate, the channel plate comprises a stack of hollow tubes, e.g. hollow glass fibres, extending between an input face and an output face. A (voltage) potential difference is applied between the input face and the output face of the channel plate, such that an electron entering a channel at the input face moves in the direction of the output face, in which displacement the number of electrons is increased by secondary emission effects. After leaving the channel plate at the output face these electrons (primary electrons and secondary electrons) are accelerated in the usual manner in the direction of the anode.

The use of a microchannel plate has some drawbacks in terms of constructional dimensions, power consumption utilizing high voltage potentials for directing the primary and secondary electrons towards the anode, the image quality.

Prior art electron multiplying structures such as the structure disclosed in US 2005/0104527 A1, make use of a layer containing diamond for secondary electron emission, wherein the diamond containing layer emits electrons into the vacuum towards a detection window. Such diamond containing layers for secondary electron emissions sill have a relative low secondary emission yield, being the amount of secondary electrons emitted per incident particle.

SUMMARY

Disclosed embodiments provide a novel electron multiplying principle having an improved performance in term of constructional dimensions, simpler construction, significant less robust construction of the power supply means, lesser sensitivity to magnetic fields, and an improved S/N characteristic.

Disclosed embodiments also provide a novel electron multiplying principle having an increased secondary emission yield.

BRIEF DESCRIPTION OF THE DRAWINGS

The disclosed embodiments will be explained in greater detail below with reference to the appended drawing.

DETAILED DESCRIPTION

Figure 1:
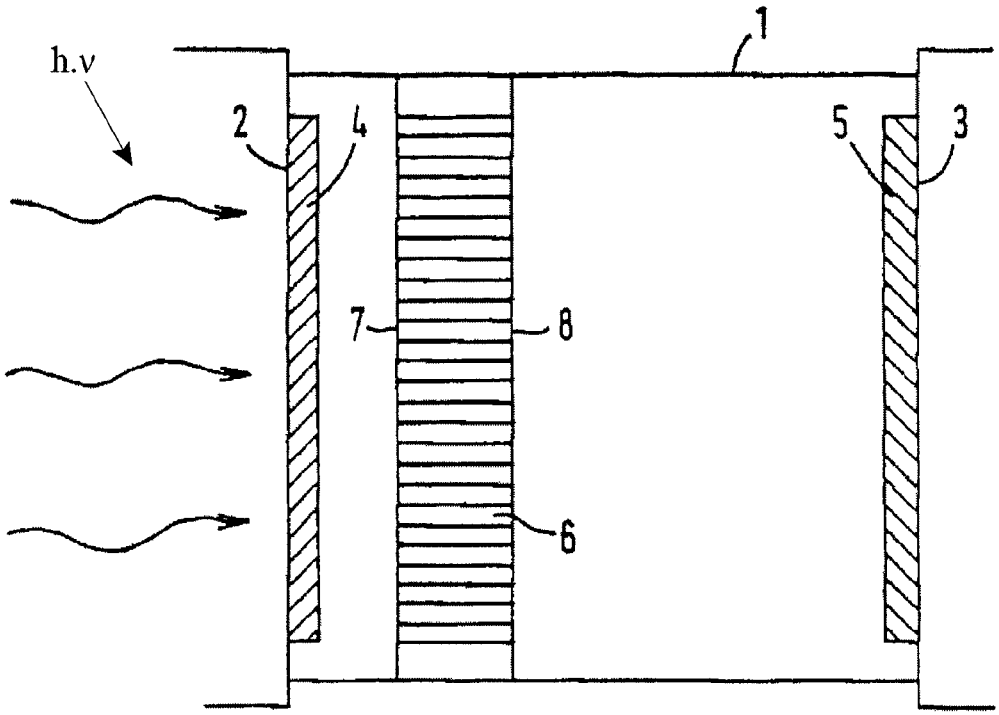
Fig. 1 PRIOR ART
FIG. 1 is a vacuum tube provided with an electron multiplying structure according to the state of the art.

According to the disclosed embodiments, an electron multiplying structure is proposed for use in a vacuum tube using electron multiplying. The electron multiplying structure comprising an input face intended to be oriented in a facing relationship with an entrance window of the vacuum tube. It furthermore comprises an output face intended to be oriented in a facing relationship with a detection surface of the vacuum tube. The electron multiplying structure at least is composed of a semi-conductor material layer which is adjacent to the detection surface of the vacuum tube.

When such electron multiplying structure being composed of a semi-conductor material layer is impacted by a particle with sufficient energy (for example an electron or another type of particle such as an ion), the particle will create an electron hole pair, resulting in the semi-conductor material layer becoming locally conductive for a time equal to the life time of the electron hole pair.

With this mechanism it is possible to 'transport' electrons through the semi-conductor material layer during this period of conductivity. The "electron conductive gain" is equal to the number of electrons which can be transported through the material layer per incident charged particle. Every induced particle on the semi-conductor material layer will create an electron hole pair allowing transport of many electrons though the semi-conductor layer. A strong gain is achieved and like a conventional transistor, the induced particle is comparable with a current on the drain of a transistor, whereby a current flows from the collector to the emitter being an amplification of the current on the drain. A single induced particle on the semi-conductor layer will in its most simple embodiment trigger a transport of plural electrons through the semi-conductor layer. Herewith per incident particle a large amount of secondary electrons are emitted from the semi-conductor layer and, therefore, a high secondary emission yield is achieved.

Optionally, the semi-conductor material layer has a band gap of at least 2 eV, whereas in another disclosed embodiment, the semi-conductor material layer may comprise at least one compound taken from the group III-V or group II-VI of the periodic table of the chemical elements. Suitable compounds are aluminium nitride, gallium nitride or boron nitride. Also silicon carbide is a suitable compound for use in an electron multiplying structure.

In yet another disclosed embodiment, the semi-conductor material layer is a diamond-like material layer, which diamond-like material layer may be applied as a monocrystalline diamond film, as a polycrystalline diamond film, as a nanocrystalline diamond film or as a coating of nano particle diamond, diamond like carbon or graphene.

When the semi-conductor material layer is now impacted by primary charged particles with sufficient energy to create one or more electron hole pairs, the material becomes conductive for a period equal to the life time of the carrier. As a result a current between the electrodes will flow. When the material is chosen correctly, the conductive current can be much higher than the impacting primary current of charged particles. The "electro conductive gain" is equal to the number of electrons which can be transported through the semi-conductor material layer per incident charged particle.

To benefit from this effect the electron multiplying structure comprises electric field generating means for generating an electric field across the semi-conductor material layer. When there are no impacting charged particles, the applied voltage will only yield a very small leakage current.

However, with every incident particle plural electrons are transported thought the semi-conductor material layer, which may even result in a gain of hundreds of electrons per incident particle. The applied electric field across the semi-conductor material layer will further enhance the transistor like function of the semi-conductor layer. A stronger electric field results in a higher gain.

This effect is even further benefit from when the electric field is applied across the semi-conductor material layer as well as the detection surface. In such a disclosed embodiment there is an enhance transport of the electrons into the detection surface.

In a first disclosed embodiment, the semi-conductor material layer is provided with a pattern of electrodes disposed on the input face of the electron multiplying structure, wherein the pattern of electrodes are disposed adjacent to each other.

In yet another disclosed embodiment, each of the electrodes is provided with at least two electrode legs, extending between the legs of a corresponding electrode.

In yet another disclosed embodiment, the pattern of electrodes is disposed on the input and on the output face of the electron multiplying structure.

In a further disclosed embodiment, the electron multiplying structure comprises an organic light emitting diode layer on which organic light emitting diode layer the material layer is disposed. An organic light emitting diode layer functions as a very efficient light emitter, further limiting the power consumption of the device.

A simple manufacturing of the device is achieved as in a further disclosed embodiment the electron multiplying structure comprises an anode layer on which anode layer the organic light emitting diode layer is disposed. This construction not only provides a further reduction in constructional dimensions but also simplified manufacturing process steps, suited for mass production.

In at least one disclosed embodiment, the anode layer is constructed as an indium-tin-oxide layer.

Optionally, between the semi-conductor material layer and the organic light emitting diode layer a metal pixel structure is disposed, with a pixel size of the metal pixel structure of 1×1 μm to 20×20 μm.

In order to improve the MTF characteristics of the electron multiplying structure the gaps between the pixels of the metal pixel structure are filled with a filler material having opaque light characteristics.

Furthermore, the semi-conductor material layer has a thickness between 50 nm and 100 μm.

In order to further reduce the constructional dimensions of the vacuum tube in a disclosed embodiment the electron multiplying structure is mounted to the detection surface of the vacuum tube.

For the sake of clarity in the following detailed description all like parts are denoted with the same reference numerals.

FIG. 1 shows schematically, in cross section, an example of a vacuum tube, for example an image intensifier. The image intensifier tube comprises a tubular housing 1 having an entrance or cathode window 2 and a detection or anode window 3. The housing can be made of glass, as can the cathode window and the anode window. The detection window 3 is, however, also often an optical fibre plate or constructed as a scintillating screen or as a pixilated array of elements (such as a semi-conductor active pixel array). The housing can also be made of metal, in the event of the cathode and possibly the anode being arranged in an insulated manner in the housing, for example by using a separate carrier.

If the image intensifier is designed for receiving X-rays, the cathode window can be made of a thin metal. The anode window can, however, be light-transmitting. The cathode 4 can also be provided directly on the input face 7 of the channel plate 6. All such variants are known per se and are therefore not shown in greater detail.

In the example shown, the actual cathode 4 is on the inside of the entrance window 2 and emits electrons under the influence of incident light or x-rays (indicated in FIGS. 1-5 with "h.ν"). The emitted electrons are propelled in a known manner under the influence of an electric field (not shown) in the direction of an anode 5 disposed on the inside of the detection window 3.

An electron multiplying structure in this disclosed embodiment constructed as a micro channel plate 6 (MCP) extending approximately parallel to cathode 4 and anode 5 is placed between cathode and anode. A large number of tubular channels, which can have a diameter, e.g., of the order of 4-12 μm, extend between the input face 7 of the channel plate facing the entrance window 2 (cathode 4) and the output face 8 of the channel plate facing the detection surface 3 (anode 5).

As mentioned hereinabove in a known image intensifier the gain in electrons is achieved using a microchannel plate and an additional phosphor layer. The number of electrons is increased by secondary emission effects and primary electrons and secondary electrons are accelerated inside the micro channel plate using an additional voltage potential difference which is applied between the input face and the output face of the channel plate. After leaving the channel plate at the output face these electrons (primary electrons and secondary electrons) are accelerated towards the anode/phosphor layer, where the electric current of electrons is converted into a photon image signal for further processing.

As stipulated above the use of a micro channel plate causes several drawbacks concerning the image quality, the complexity in manufacturing as well as the additional required electronics, such as means for applying a high voltage potential difference across the input face and the output face of the channel plates in order to cause a significant acceleration of the electrons thereby adding to the generation of secondary electrons by means of emission effects in the micro channel plate material.

In the known intensifier vacuum tube devices the gain is obtained in three separate stages. First there is the mechanism of impinging photons generating primary electrons in the photocathode layer 2. These free electrons are accelerated towards the microchannel plate 6 where the second multiplication phenomenon occurs: the primary electrons coming from the photocathode impinge on the microchannel plate material and generate secondary electrons. The primary and secondary electrons are then accelerated towards the anode 3 which is optionally provided with a phosphor layer wherein the electron current is converted in a photon signal which light signal is read out for further processing.

According to at least one disclosed embodiment, a novel electron multiplying principle is proposed having, when incorporated in a device, a very compact construction in term of dimensions an improved S/N ratio requiring a less complicated electrons in terms of the voltage potential difference applied and which is suited for mass manufacturing under very clean industrial clean room processing steps.

Figure 2:
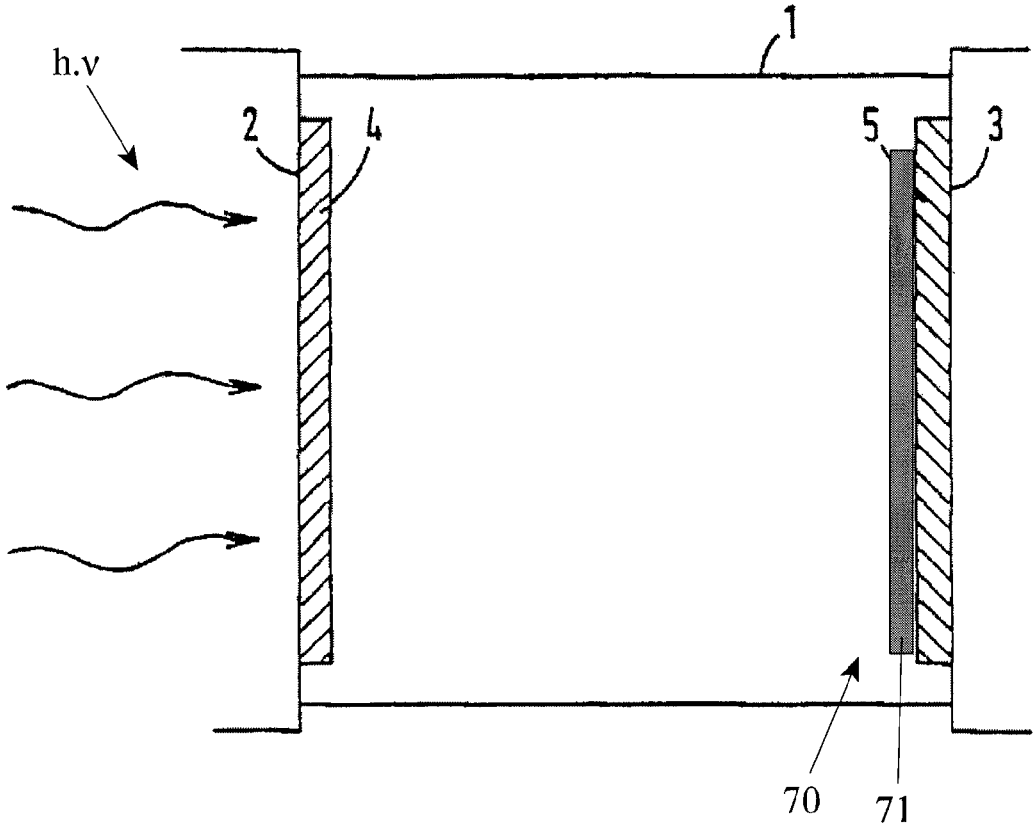
FIG. 2 is a first disclosed embodiment of a vacuum tube using electron multiplying with an electron multiplying structure.

In FIG. 2, an embodiment of such electron multiplying structure is disclosed.

In FIG. 2 the novel electron multiplying structure is denoted with reference numeral 70 and the electron multiplying structure 70 is at least composed of a semi-conductor material layer 71 which is applied as a thin monocrystalline or polycrystalline diamond film or a nano diamond particle coating adjacent and directly attached to the detection window. The semi-conductor layer 71 is in such a way attached to the detection window 3 that transport of electrons from the semi-conductor layer 71 to the detection window 3 is enabled. Herewith an impinging particle on the multiplying structure 70, i.e. an electron, creates an electron hole pair from the semi-conductor layer 71 up till the detection window 3. From this electron hole pair many electrons, even up to hundreds, are transported through the semi-conductor layer 71 to the detection window 3. This way a higher secondary electron yield is achieved then in prior art electron multiplying structures.

More in particular the electron multiplying structure is composed of a material layer having a band gap of at least 2 eV.

In the electron multiplying structure 70, a new gain mechanism takes place in the semi-conductor material layer. One single electron hole pair being created in the photo cathode due to a single photon impinging on the cathode may result in the generation of several hundreds of secondary electrons, especially as the recombination lifetime of an electron hole pair in the semi-conductor material is extremely long compared with for instance silicon in ordinary multi channel plates.

Figure 3A:
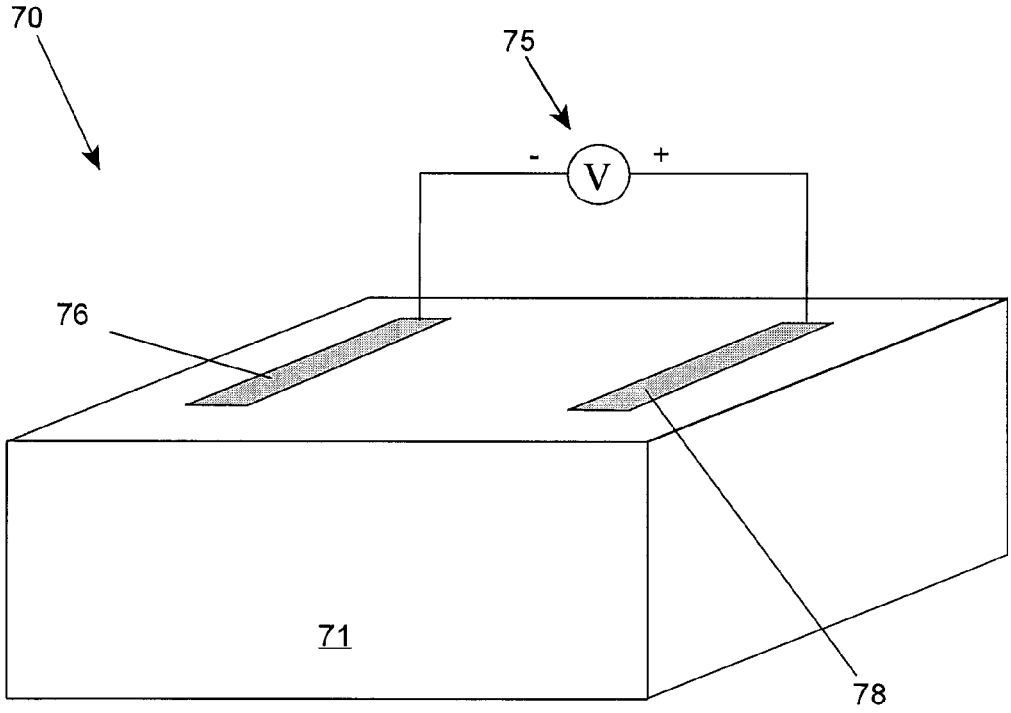
FIGS. 3*a*-3*c* are more detailed embodiments of the vacuum tube disclosed in FIG. 2.
Figure 3B:
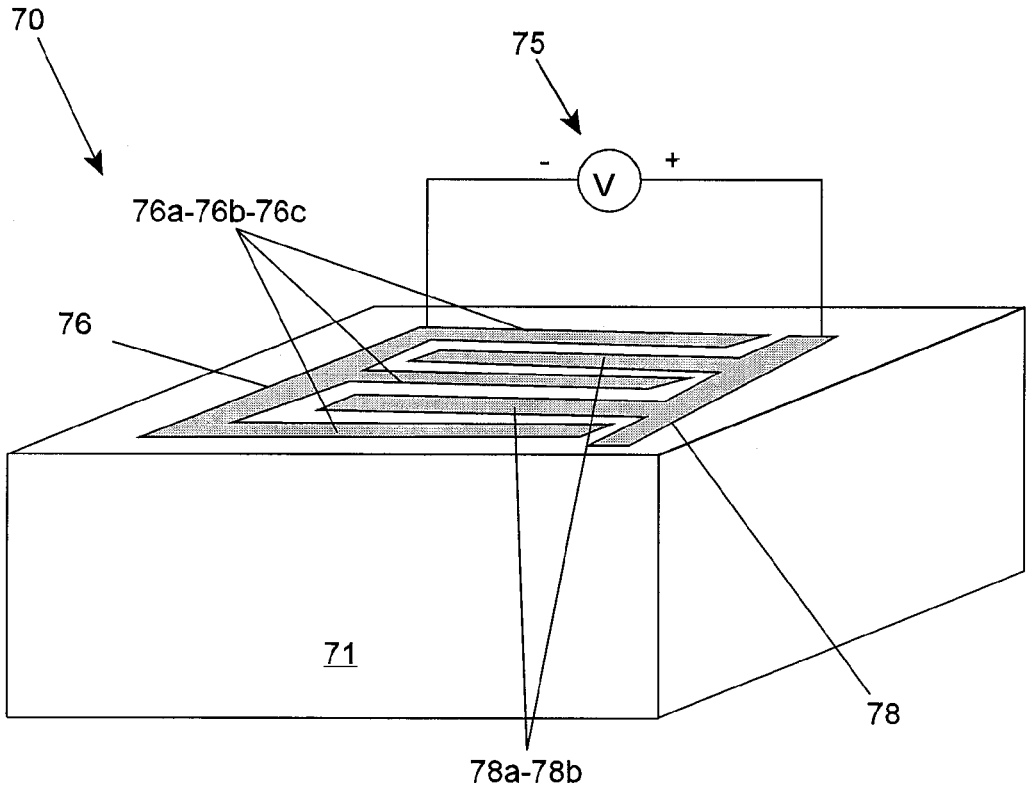
Figure 3C:
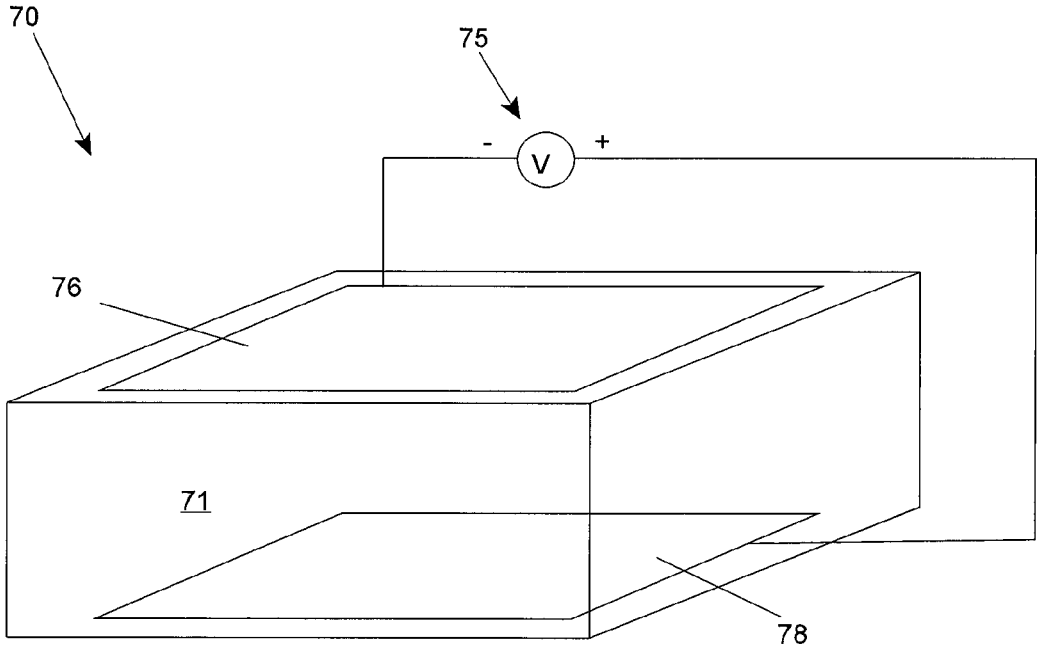

In FIGS. 3*a*-3*c* multiple embodiments are disclosed of the novel electron multiplying principle. In these Figures reference numeral 71 denotes a semiconductive material layer 71 which is applied as a thin monocrystalline or polycrystalline diamond film or a nano diamond particle coating.

In the disclosed embodiment of FIG. 3*a*, two line shaped electrodes 76-78 are connected to a suitable voltage supply 75. The line shaped electrodes 76-78 are accommodated on one face of the semi-conductor material layer 71. As in the disclosed embodiment of FIG. 2 in the semi-conductor material layer 71 the new gain mechanism takes place by the electron hole pairs being created due to photons impinging on the structure 70. The electron hole pair being created will make the semi-conductor material 71 locally conductive for a time equal to the lifetime of the created carrier. During this period of conductivity transport of electrons through the semi-conductor material 71 is possible between the two electrodes 76-78.

According to the novel electron multiplying principle, the electron conductive gain is equal to the number of electrons which can be transported through the semi-conductor material per incident particle. Hereto on the semi-conductor material layer 71 conductive electrodes are fitted as indicated with reference numerals 76 and 78.

When there are no impinging particles entering the input face of the electron multiplier structure 70, the applied voltage by the voltage supply 75 will only yield a very small leakage current between the two electrodes 76-78.

In the event that the semi-conductor material between the two electrodes 76-78 is impacted by a primary particle having sufficient energy to create one or more electron hole pairs, the semi-conductor material 71 becomes conductive for a period equal to the lifetime of the created carrier. A current will flow between the electrodes 76-78 and depending on the correct material being chosen the conductive current can be much higher than the impacting primary particles. The electro conductive gain is equal to the number of electrons which can be transported through the material between the electrodes 76-78 and is also dependent from the distance between the two electrodes.

A suitable semi-conductor material 71 appears to be diamond which can be used in different embodiments such as monocrystalline, polycrystalline, nanocrystalline in the form of a coating of nano particle diamonds, diamond-like carbon or graphene. Also other III-V or II-IV crystal structures like aluminum nitride, gallium nitride or boron nitride can be used.

In the FIGS. 3*a* and 3*b*, two embodiments of an electron multiplying structure 70 operating as a conductive gain amplifier are disclosed exhibiting a so-called two dimensional construction. In the disclosed embodiments of FIGS. 3*a* and 3*b* the electrodes 76-78 are positioned on the same face of the semi-conductor material layer 71.

In FIG. 3*a* two line or square shaped electrodes 76-78 are deposited next to each other with an area between the two electrodes. Another disclosed embodiment incorporating a higher sensitive area is disclosed in FIG. 3*b* where the electrodes 76-78 are so-called intertwined electrodes wherein each electrode 76-78 has multiple legs 76*a*-76*b*-76*c* and 78*a*-78*b* respectively, which are intertwined.

Another embodiment is disclosed in FIG. 3*c*, wherein a so-called three dimensional electron multiplying structure is disclosed. In this disclosed embodiment the electron current is conducted through the semi-conductor layer from the cathode surface (on which electrode 76 is located) towards the anode surface on which the electrode 78 is positioned. In this disclosed embodiment the thickness of the semi-conductor layer 71 is important for a proper operation and has a thickness typically between 50 nm and 100 μm.

Although in FIG. 3*c* the electrode 76 on the cathode face of the electron multiplying structure 70 is constructed as a thin plate shaped electrode other configurations are suitable such as a grit or a thin layer of metal, a thin layer of a semi-conductor material or an applied doping to the semi-conductor material 71 in order to prevent any obstruction of the primary particles impinging on the input face of the electron multiplying structure 70.

The anode electrode 78 receives the electron gain current through the semi-conductor material 71 and exits it outside the device for further processing.

Also in this disclosed embodiment the anode electrode 78 can be manufactured as a continuous layer of a conductor or a semi-conductor material or can be shaped as a grit or a pixel size layer or as a layer having a negative electron affinity does re-emitting the electrons from the semi-conductor material 71 back into the vacuum environment. For implementing this latter disclosed embodiment the anode layer 78 can be composed from alkalimetals, optionally containing Cesium.

Figure 4:
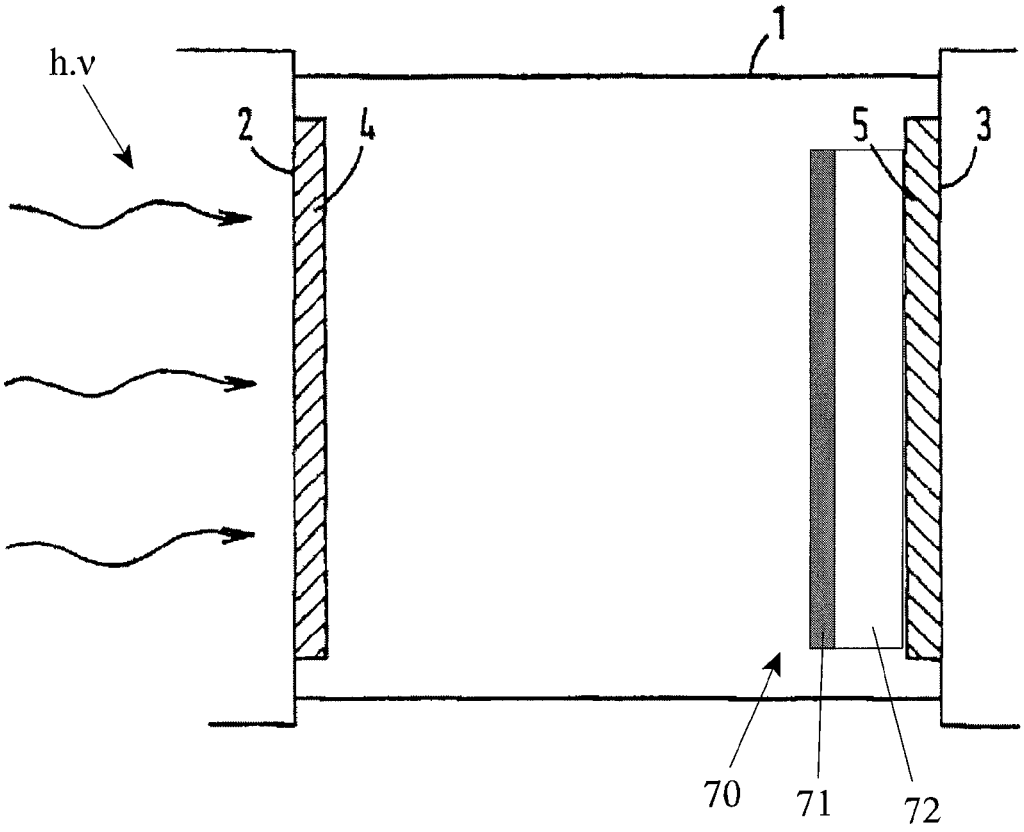
FIG. 4 is another disclosed embodiment of a vacuum tube using electron multiplying with an electron multiplying structure.

In FIG. 4 another embodiment of an electron multiplying structure implemented in a vacuum tube is disclosed.

In FIG. 4 the novel electron multiplier applying structure is denoted with reference numeral 70 and the electron multiplying structure 70 is at least composed of a semi-conductor material layer 71 which is applied as a thin monocrystalline or polycrystalline diamond film.

Furthermore the electron multiplying structure 70 comprises an organic light emitting diode layer 72 on which organic light emitting diode layer 72 the semi-conductor material layer is disposed. The organic light emitting diode layer 72 transforms the electric signal corresponding to the amplified electron current leaving the semi-conductor layer 71 into visible light. This visible light signal is transferred through the organic light emitting device layer 72 towards the anode 5.

A simplified construction with limited constructional dimensions also resulting in a simpler construction in terms of manufacturing process steps is herewith obtained as the semi-conductor material layer 71 and the organic light emitting diode layer 72 are mounted to the anode 3 of the vacuum tube. Optionally, the anode layer 3 is constructed as an indium-tin-oxide layer.

Figure 5:
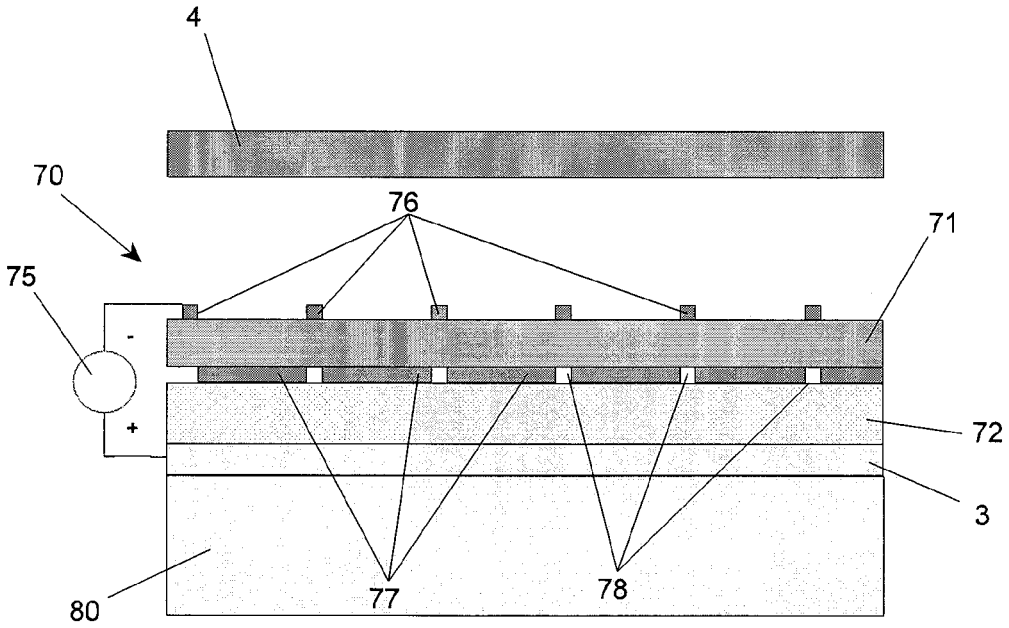
FIG. 5 is a more detailed embodiment of the vacuum tube disclosed in FIG. 4.

As clearly depicted in FIG. 5, the electron multiplying structure 70 comprises electric field generating means 75-76-77 for generating an electric field between the input face and the output face of the electron multiplying structure 70.

On the semi-conductor material layer 71*a* pattern of small transmission electrodes 76 is disposed which pattern of small transmission electrodes 76 are connected with a node of a voltage potential supply 75, whereas the anode 3 is connected with the other node of the voltage potential supply 75. Between the semi-conductor layer 71 and the organic light emitting diode layer 72 a metal pixel structure 77 is disposed which is congruent to the hole structure of the pattern of the small transmission electrodes 76 being disposed on the input face of the electron multiplying structure/the semi-conductor material layer 71. The pixel size of the metal pixel structure 77 should be as low as possible in order not to adversely affect the MTF. Optionally, the pixel size is 2×2 micrometer. The gaps 78 between the pixels 77 should be filled with an opaque gap filler to avoid light feedback from the organic light emitting diode layer 72 towards the photo cathode 2.

The voltage applied between the transmission electrodes 76 and the anode 3 by means of the voltage potential supply 75 is used as a gain control mechanism. Contrary to the high potential voltage supply used in a conventional vacuum tube the voltage potential supply 75 is of a limited construction and is capable in supplying only a medium voltage potential (500-2000 Volt) and/or one low voltage potential (10-100 Volt). This does not adversely affect the electron gain mechanism in the semi-conductor material layer but further reduces the constructional dimensions of the device and its price. When GaAs as is used as a photocathode material an improved S/N ratio is obtained which is comparable with the known EBCMOS devices.

The use of an electron multiplying structure allows for the construction of a vacuum tube having a very small envelope and very low power consumption of a few mVolt.

Figure 6:
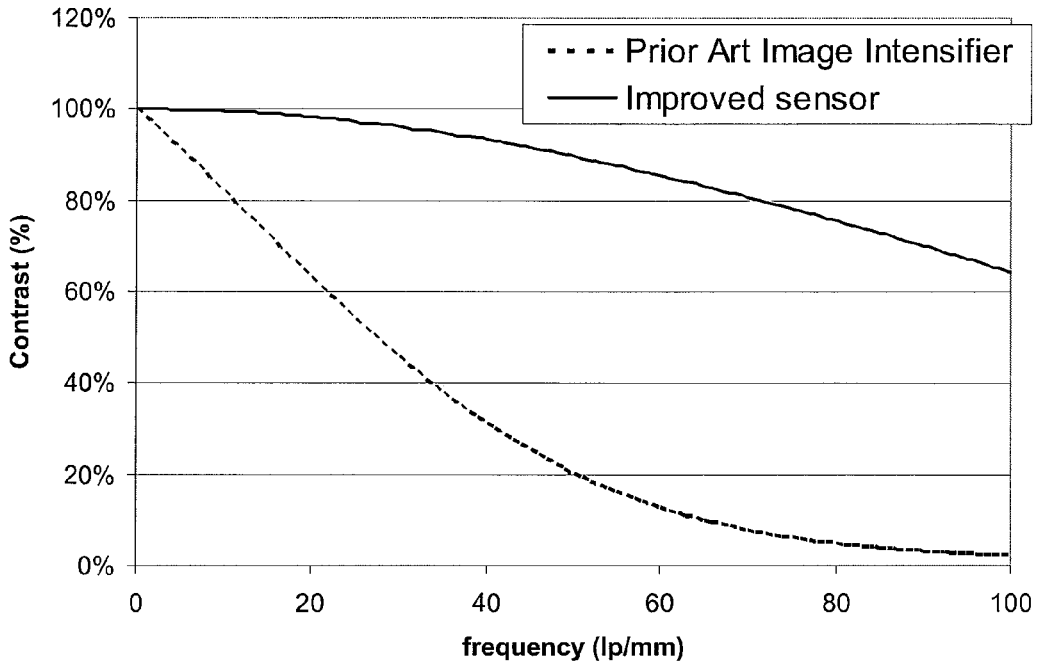
FIG. 6 is a diagram depicting the MTF characteristics of a vacuum tube with an electron multiplying structure according to the prior art and the disclosed embodiments.

Due to the absence of an ordinary micro channel plate as in the state of the art devices the electron multiplying structure 70 has a significant improved MTF as shown in FIG. 6.

It is clear that with the novel electron multiplying structure an improved gain principle is obtained which can be implemented in several different embodiments such as electron bombarded CMOS emitters, dynodes etc.

The invention claimed is:

1. An electron multiplying structure in a vacuum tube using electron multiplying, the electron multiplying structure comprising:

an input face intended to be oriented in a facing relationship with an entrance window of the vacuum tube, an output face intended to be oriented in a facing relationship with a detection surface of the vacuum tube, wherein the electron multiplying structure at least is composed of a semi-conductor material layer, wherein the semi-conductor material layer is adjacent and directly attached to the detection surface of the vacuum tube.

2. The electron multiplying structure of claim 1, wherein the semi-conductor material layer has a band gap of at least 2 eV.

3. The electron multiplying structure of claim 1, wherein the semi-conductor material layer comprises at least one compound taken from the group III-V or group II-VI of the periodic table of the chemical elements.

4. The electron multiplying structure of claim 1, wherein the semi-conductor material layer comprises any one of the group consisting of a diamond-like material layer, a mono monocrystalline diamond film, a polycrystalline diamond film and a nanocrystalline diamond film.

5. The electron multiplying structure of claim 4, wherein the diamond-like material layer is applied as a coating of nano particle diamond, diamond like carbon or graphene.

6. The electron multiplying structure of claim 1, wherein the electron multiplying structure comprises an electro luminescent material on which electro luminescent material the semi-conductor material layer is disposed.

7. The electron multiplying structure of claim 6, wherein the electro luminescent structure is an organic light emitting layer.

8. The electron multiplying structure of claim 6, wherein the electron multiplying structure comprises an anode layer on which anode layer the organic light emitting layer is disposed.

9. The electron multiplying structure of claim 8, wherein the anode layer is constructed as an indium-tin-oxide layer.

10. The electron multiplying structure of claim 1, wherein the electron multiplying structure comprises electric field generating means for generating an electric field across the semi-conductor material layer.

11. The electron multiplying structure of claim 10, wherein the semi-conductor material layer is provided with a pattern of electrodes disposed on the input face of the electron multiplying structure.

12. The electron multiplying structure of claim 10, wherein between the semi-conductor material layer and the organic light emitting layer a metal pixel structure is disposed.

13. The electron multiplying structure of claim 12, wherein the gaps between the pixels of the metal pixel structure are filled with a filler material having opaque light characteristics.

14. The electron multiplying structure of claim 1, wherein the electron multiplying structure comprises electric field generating means for generating an electric field across both the semi-conductor material layer and the detection surface.

15. A vacuum tube for use as an electron multiplier at least having an electron multiplying structure according to claim 1.

* * * * *